US009004627B2

(12) United States Patent
Izawa et al.

(10) Patent No.: US 9,004,627 B2
(45) Date of Patent: Apr. 14, 2015

(54) INKJET RECORDING APPARATUS

(71) Applicants: Hideo Izawa, Narashino (JP); Takao Namiki, Narashino (JP); Akira Ishikawa, Narashino (JP); Wataru Itabashi, Narashino (JP)

(72) Inventors: Hideo Izawa, Narashino (JP); Takao Namiki, Narashino (JP); Akira Ishikawa, Narashino (JP); Wataru Itabashi, Narashino (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 0 days.

(21) Appl. No.: 13/928,434

(22) Filed: Jun. 27, 2013

(65) Prior Publication Data

US 2014/0043381 A1 Feb. 13, 2014

(30) Foreign Application Priority Data

Aug. 10, 2012 (JP) ..... 2012-178184

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC ..... B41J 2/17596; B41J 2/18; B41J 2/1707
See application file for complete search history.

(56) References Cited

U.S. PATENT DOCUMENTS

| | | | | |
|---|---|---|---|---|
| 2006/0221146 | A1 | 10/2006 | Slotto et al. | |
| 2008/0273063 | A1 * | 11/2008 | Wouters et al. | 347/85 |
| 2010/0039460 | A1 * | 2/2010 | Delueg | 347/7 |
| 2010/0177148 | A1 * | 7/2010 | Asami | 347/85 |

FOREIGN PATENT DOCUMENTS

EP 2 402 164 A1 1/2012

OTHER PUBLICATIONS

Search Report of European Patent Office issued in European Application No. 13 17 2443.7 dated Dec. 20, 2013 (6 pages).

* cited by examiner

*Primary Examiner* — Julian Huffman
(74) *Attorney, Agent, or Firm* — Flynn, Thiel, Boutell & Tanis, P.C.

(57) ABSTRACT

An inkjet recording apparatus which can make a distribution tank compact and has excellent pressure-control precision is provided with an inkjet portion A having a recording head 11 for applying ink to a recording medium 1 and a distribution tank 12 for supplying ink to the recording head 11, an ink supply means B having a main tank 21 for supplying ink to the distribution tank 12, and an air supply means C having an air chamber 31 communicating with a space 12*a*in the distribution tank 12 and a pressure adjustment mechanism provided on the air chamber 31 via a solenoid valve, where the pressure of the space 12*a* and the internal pressure of the air chamber 31 are equal to each other.

8 Claims, 7 Drawing Sheets

INKJET RECORDING APPARATUS

TECHNICAL FIELD

The present invention relates to an inkjet recording apparatus, and in particular to an inkjet recording apparatus of a pressure control type can make a distribution tank compact and has excellent pressure-control precision.

BACKGROUND ART

Inkjet recording apparatuses are used in various fields since they can perform high-speed successive recording of designs or characters based on predetermined image data.

Examples of such inkjet recording apparatuses include a known inkjet recording apparatus provided with a back-pressure tank, a distribution tank, an ink on-off solenoid valve, and a recording head (for example, see Patent Literature 1 or 2).

By the way, in these inkjet recording apparatuses, since ink is supplied by making use of a water head difference between the liquid level in the back-pressure tank and the recording head, there is a certain limitation in a positional relation between the back-pressure tank and the recording head.

In addition, since a route through which ink passes from the back-pressure tank to the recording head is long, there is such a drawback that pressure loss occurs.

Further, since the pressure on ink in the recording head varies according to the liquid level in the back-pressure tank, there is the drawback that the discharge amount or discharge velocity of the ink becomes unstable.

In order to overcome these drawbacks, an inkjet recording apparatus of a pressure control type that controls pressure instead of making use of a water head difference has been developed.

For example, there is an inkjet recording apparatus provided with a main tank, a sub tank, a print head (recording head), a pressure detecting means for detecting a pressure in the sub tank, an air suction means, and an air replenishment pump (for example, see Patent Literature 3).

CITATION LIST

Patent Literature

PTL 1: Japanese Patent Application Laid-Open No. 2012-11668

PTL 2: Japanese Patent Application Laid-Open No. 2012-11669

PTL 3: Japanese Patent No. 4734938

SUMMARY OF INVENTION

Technical Problem

However, in the above inkjet recording apparatus described in Patent Literature 3, since the volume of the sub tank is small, pressure control becomes difficult, so that it cannot be said that the precision is excellent.

In addition, since the pressure detecting means, the air suction means, and the air replenishment pump need to be attached to the sub tank, the structure of the apparatus becomes complicated, and the weight of the sub tank also increases. Therefore, the sub tack cannot be moved efficiently.

Further, since the sub tank itself becomes large, there is also the drawback that an extra space for installation is required.

The present invention has been made in view of the above circumstances, and an object of the present invention is to provide an inkjet recording apparatus which can make a distribution tank (sub tank) compact and has excellent pressure-control precision.

Solution to Problems

The present inventors have made intensive research to solve the above problems and have completed the present invention based on the finding that the above problems can be solved by disposing at a separate location an air chamber communicating with a space in a distribution tank and attaching a pressure adjusting mechanism to the air chamber.

The present invention lies in (1) an inkjet recording apparatus including: an inkjet portion having a recording head for applying ink to a recording medium and a distribution tank for supplying ink to the recording head; an ink supply means having a main tank for supplying ink to the distribution tank; and an air supply means having an air chamber communicating with a space in the distribution tank and a pressure adjustment mechanism provided on the air chamber via a solenoid valve, wherein the pressures of the space and internal pressure of the air chamber are equal to each other.

The present invention lies in (2) the inkjet recording apparatus according to the above (1), wherein the internal volume of the air chamber is larger than the volume of the space.

The present invention lies in (3) the inkjet recording apparatus according to the above (1), wherein the volume ratio of a volume R1 of the space to an internal volume R2 of the air chamber (R1:R2) is in a range of 1:1.28 to 1:73.3.

The present invention lies in (4) the inkjet recording apparatus according to any one of the above (1) to (3), wherein: the ink supply means and the air supply means are contained in a fluid portion; and the inkjet portion and the fluid portion are separate members.

The present invention lies in (5) the inkjet recording apparatus according to any one of the above (1) to (4), wherein the distribution tank supplies the ink to the recording head via an ink on-off solenoid valve.

The present invention lies in (6) the inkjet recording apparatus according to any one of the above (1) to (5), wherein the main tank supplies ink to the distribution tank via a deaerating module.

The present invention lies in (7) the inkjet recording apparatus according to any one of the above (1) to (6), wherein the distribution tank is provided with a circulation port; and ink in the distribution tank is circulated from the circulation port to the main tank through a circulating flow passage connected to the circulation port.

The present invention lies in (8) the inkjet recording apparatus according to any one of the above (1) to (7), wherein: the recording head includes a plurality of recording head sections; the distribution tank includes a plurality of distribution tank sections corresponding to the number of the recording head sections; and spaces in the distribution tank sections communicate with the air chamber which is one in number.

The present invention lies in (9) the inkjet recording apparatus according to any one of the above (1) to (8), wherein the pressure adjustment mechanism includes: a vacuum pump attached to the air chamber via a pressure-reducing solenoid valve; an air filter attached to the air chamber via an ambient-air solenoid valve so as to communicate with ambient air; and a pressurizing pump attached to the air chamber via a pressurizing solenoid valve.

The present invention lies in (10) a method for controlling the inkjet recording apparatus according to any one of the above (1) to (9), including the steps of: performing control to make the pressure in the air chamber negative during inkjet recording and during storage of the recording head; and performing control to make the pressure in the air chamber positive during restoring work where the ink is forcibly discharged from the recording head.

The present invention lies in (11) a method for controlling the inkjet recording apparatus according to the above (9), including the steps of: performing control to make the pressure in the air chamber negative during inkjet recording and during storage of the recording head; performing control to make the pressure in the air chamber positive during restoring work where the ink is forcibly discharged from the recording head; and shifting the pressure in the air chamber to atmospheric pressure via the air filter temporarily in the course of changing from the negative pressure to the positive pressure or changing from the positive pressure to the negative pressure.

Advantageous Effects of Invention

In the inkjet recording apparatus of the present invention, since the pressure in the air chamber is equal to the pressure of the space in the distribution tank, by adjusting the pressure in the air chamber, the pressure of the space in the distribution tank can be similarly adjusted. Therefore, for example, according to the specifications of the inkjet recording apparatus, the air chamber can be installed at an arbitrary location.

At this time, if the internal volume of the air chamber is larger than the volume of the space, the pressure in the distribution tank can be controlled with higher precision. That is, since controlling the pressure in the distribution tank is performed through controlling the pressure in the air chamber, for example, a sudden change in pressure never occurs directly in the distribution tank.

In the inkjet recording apparatus of the present invention, since the air chamber is disposed at a separate location, the pressure adjustment mechanism can be attached to the air chamber. Therefore, the distribution tank to which the pressure adjustment mechanism is not directly attached can be made more compact. This provides the merit that a large space to install the distribution tank is not required, and, since the weight of the distribution tank can also be reduced, the inkjet portion including the distribution tank can be moved very efficiently.

Incidentally, since the inkjet recording apparatus of the present invention is of a pressure control type, a positional relation between the main tank and the recording head is not limited, so that a route through which ink flows from the main tank to the recording head can be shortened in order to reduce pressure loss, and the ink discharge amount or discharge velocity can be stabilized. As a result, high-speed and high-coverage inkjet recording becomes possible.

In the inkjet recording apparatus of the present invention, when the ink supply means and the air supply means are contained in the fluid portion, and the inkjet portion and the fluid portion are separate members, the inkjet portion can be made more compact, and the fluid portion can be disposed at an unobstructive desired location. Thereby, the working capacity of the inkjet recording can also be improved.

In the inkjet recording apparatus of the present invention, when the distribution tank is configured to supply ink to the recording head via an ink on-off solenoid valve, ink can be forcibly supplied to the recording head. Thereby, clogging of the recording head or the like can be prevented or eliminated.

In the inkjet recording apparatus of the present invention, when the main tank is configured to supply ink to the distribution tank via a deaerating module, generation of air bubbles in the ink can be suppressed. As a result, an ink discharge defect in the recording head can be suppressed.

At this time, when the distribution tank is provided with a circulation port, and the ink in the distribution tank is circulated from the circulation port to the main tank via a circulating flow passage connected to the circulation port, the ink can be repeatedly deaerated, so that an ink discharge defect can be further suppressed in the recording head.

In the inkjet recording apparatus of the present invention, when a plurality of recording head sections are provided, a plurality of distribution tank sections are provided so as to correspond to the number of the recording head sections, and spaces in these distribution tank sections communicate with one air chamber, the pressures of the spaces in these distribution tank sections are adjusted at the same time as adjustment of the pressure in the one air chamber, so that the pressures in the individual distribution tank sections can be averaged.

In the inkjet recording apparatus of the present invention, when the pressure adjustment mechanism includes a vacuum pump attached to the air chamber via a pressure-reducing solenoid valve, an air filter attached to the air chamber via an ambient-air solenoid valve so as to communicate with ambient air, and a pressurizing pump attached to the air chamber via a pressurizing solenoid valve, the pressure can be easily adjusted.

In addition, since the air filter communicating with ambient air is used, dust can be prevented from entering the air chamber.

In the method for controlling the inkjet recording apparatus of the present invention, by controlling the pressure in the air chamber so as to become negative at the time of inkjet recording and at the time of storing the recording head, ink leakage can be suppressed, and by controlling the pressure in the air chamber to become positive, ink is forcibly discharged from the recording head, so that a discharge defect can be eliminated.

It should be noted that it is preferred that the pressure in the air chamber be temporarily shifted to atmospheric pressure via the air filter in the course of changing from the negative pressure to the positive pressure or changing from the positive pressure to the negative pressure.

DESCRIPTION OF EMBODIMENTS

Hereinafter, with reference to Figures, if necessary, preferred embodiments of the present invention will be described in detail. It should be noted that in the Figures, identical elements are denoted by identical reference signs so that the same description is not repeated. In addition, positional relationships, such as top and bottom or right and left, are based on the positional relationships in the Figures, unless otherwise noted. Further, the dimensional ratios of the drawings and ratios of illustrations are not limited to those shown in Figures.

Figure 1:
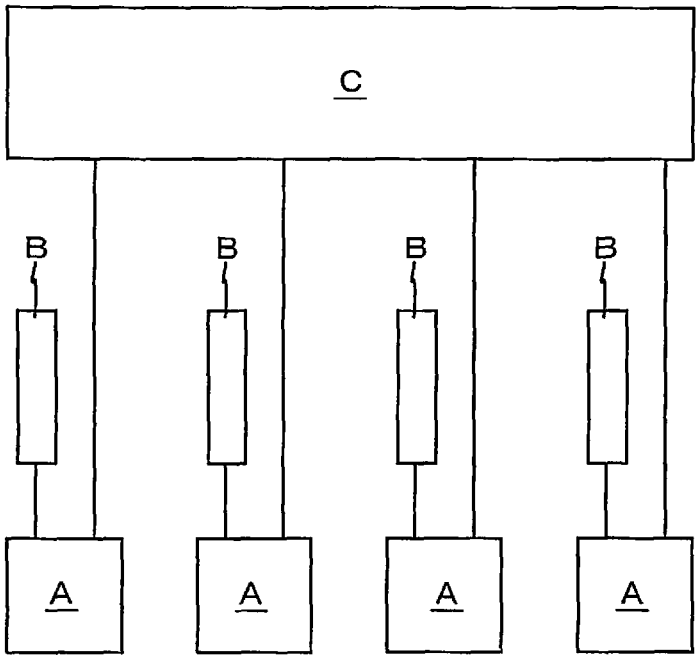
FIG. 1 is a descriptive diagram showing schematically a relationship between inkjet portions, air supply means, and an ink supply means in an inkjet recording apparatus according to an embodiment of the present invention.

FIG. 1 is a descriptive diagram showing schematically a relationship between inkjet portions, air supply means, and an ink supply means in an inkjet recording apparatus according to an embodiment of the present invention. As shown in FIG. 1, the inkjet recording apparatus according to the present invention is provided with four inkjet portions A, four ink supply means B for supplying ink to the inkjet portions A, respectively, and one air supply means C for supplying air to these inkjet portions A.

It should be noted that more specifically the inkjet portion A has a recording head for applying ink to a recording medium and a distribution tank for supplying ink to the recording head, the ink supply means B has a main tank for supplying ink to the distribution tank, and the air supply means C has an air chamber communicating with a space in the distribution tank and a pressure adjusting mechanism provided on the air chamber via a solenoid valve.

Since the inkjet recording apparatus according to the embodiment is of a pressure control type, there are no limitations on a positional relationship between the main tank and the recording head. Therefore, a route through which ink flows from the main tank to the recording head can be shortened in order to reduce pressure loss, and consequently the discharge amount or discharge velocity of the ink can be stabilized. As a result, a high-speed and high-coverage inkjet recording becomes possible.

In the inkjet recording apparatus according to the embodiment, the inkjet portions A are supplied with inks different in color by the ink supply means B, respectively.

For example, full-color inkjet recording is made possible by causing the inkjet portions A to contain yellow (Y), magenta (M), cyan (C), and black (K) inks, respectively.

Further, these inkjet portions A communicate with the one air supply means C. That is, the inkjet portions A have a plurality of recording heads, and a plurality of distribution tanks corresponding to the number of the recording heads, and spaces in these distribution tanks communicate with the one air chamber.

Therefore, by controlling the pressure in the air chamber in the air supply means C, the pressures of the spaces in the distribution tanks in these inkjet portions A are adjusted, so that the pressures in the distribution tanks in the individual inkjet portions A can be averaged.

Figure 2:
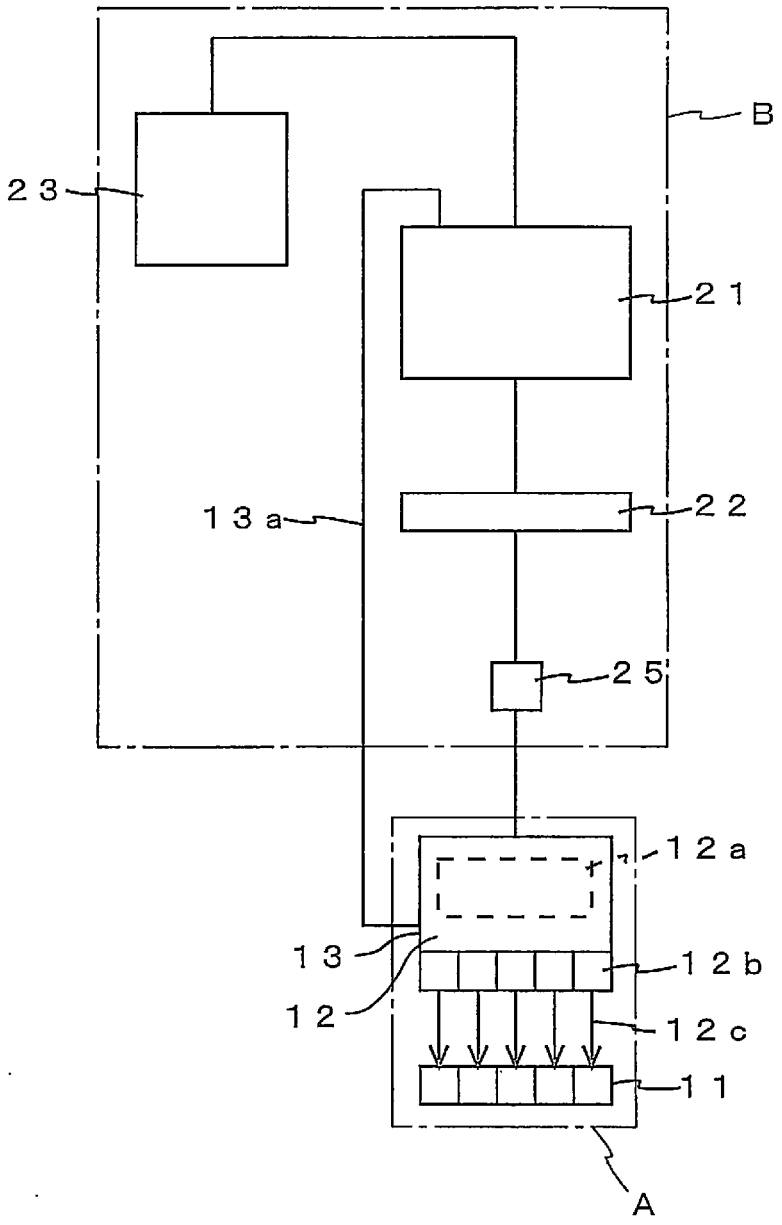
FIG. 2 is a descriptive diagram showing schematically a relationship between the inkjet portion and the ink supply means in the inkjet recording apparatus according to the embodiment.

FIG. 2 is a descriptive diagram showing schematically a relationship between the inkjet portion and the ink supply means in the inkjet recording apparatus according to the embodiment.

As shown in FIG. 2, the inkjet portion A has a recording head 11 for applying ink to a recording medium (not shown) and a distribution tank 12 for supplying the recording head 11 with ink.

A fixed line head having a plurality of nozzles is used as the recording head 11.

Further, as described above, since the inkjet portions A have a plurality of recording heads 11, different inks can be used in the respective recording heads 11.

The distribution tank 12 contains ink, and a space 12*a* is provided in the rest of the distribution tank 12. Incidentally, the fluid level of the ink within the distribution tank 12 is monitored by a float switch, and the ink is controlled so as to keep the amount within an appropriate range.

In addition, the distribution tank 12 has a built-in warming heater so that the ink is controlled so as to keep the temperature constant.

Further, a plurality of ink on-off solenoid valves 12*b* are directly attached to a lower end of the distribution tank 12, and the ink on-off solenoid valves 12*b* are connected to the corresponding recording head 11 via distribution supply pipes 12*c* attached to the ink on-off solenoid valves 12*b*, respectively.

The distribution tank 12 is configured to discharge ink from the recording head 11 according to opening and closing of the ink on-off solenoid valve 12*b*, based on a signal from a controller (not shown), after the pressure in the air chamber has been made positive.

When the ink on-off solenoid valve 12*b* is opened, the ink is forcibly supplied to the recording head 11 and discharged from the nozzles of the recording head 11. Therefore, clogging of the recording head 11 or the like can be prevented or eliminated.

The ink supply means B has a main tank 21 from which ink is supplied to the distribution tank 12 via a deaerating module 22 and an ink pack 23 from which ink is supplied to the main tank 21. Incidentally, the main tank 21 is opened to the atmosphere via an air filter (not shown).

Further, a check valve 25 for preventing backflow of ink is attached between the deaerating module 22 and the distribution tank 12.

In the ink supply means B, ink is supplied from the main tank 21 to the distribution tank 12 via the deaerating module 22 based on a signal from the float switch. Therefore, generation of air bubbles in the ink can be suppressed, and consequently an ink discharge defect in the recording head 11 can be suppressed. Incidentally, the ink is supplied by a pump (not shown).

In the inkjet recording apparatus according to the embodiment, a circulation port 13 is provided in a lower portion of the distribution tank 12 so that the ink in the distribution tank 12 is circulated through the circulation port 13 to the main tank 21 via a circulating flow passage 13*a* joined to the circulation port 13. Incidentally, the ink is circulated by a pump (not shown).

Since the ink is unidirectionally circulated between the distribution tank 12 and the main tank 21 in this manner, the ink can be deaerated repeatedly. Therefore, an ink discharge defect in the recording head can be further prevented. Incidentally, it is preferred that such circulation be performed not only during inkjet recording but also during no-recording.

Figure 3:
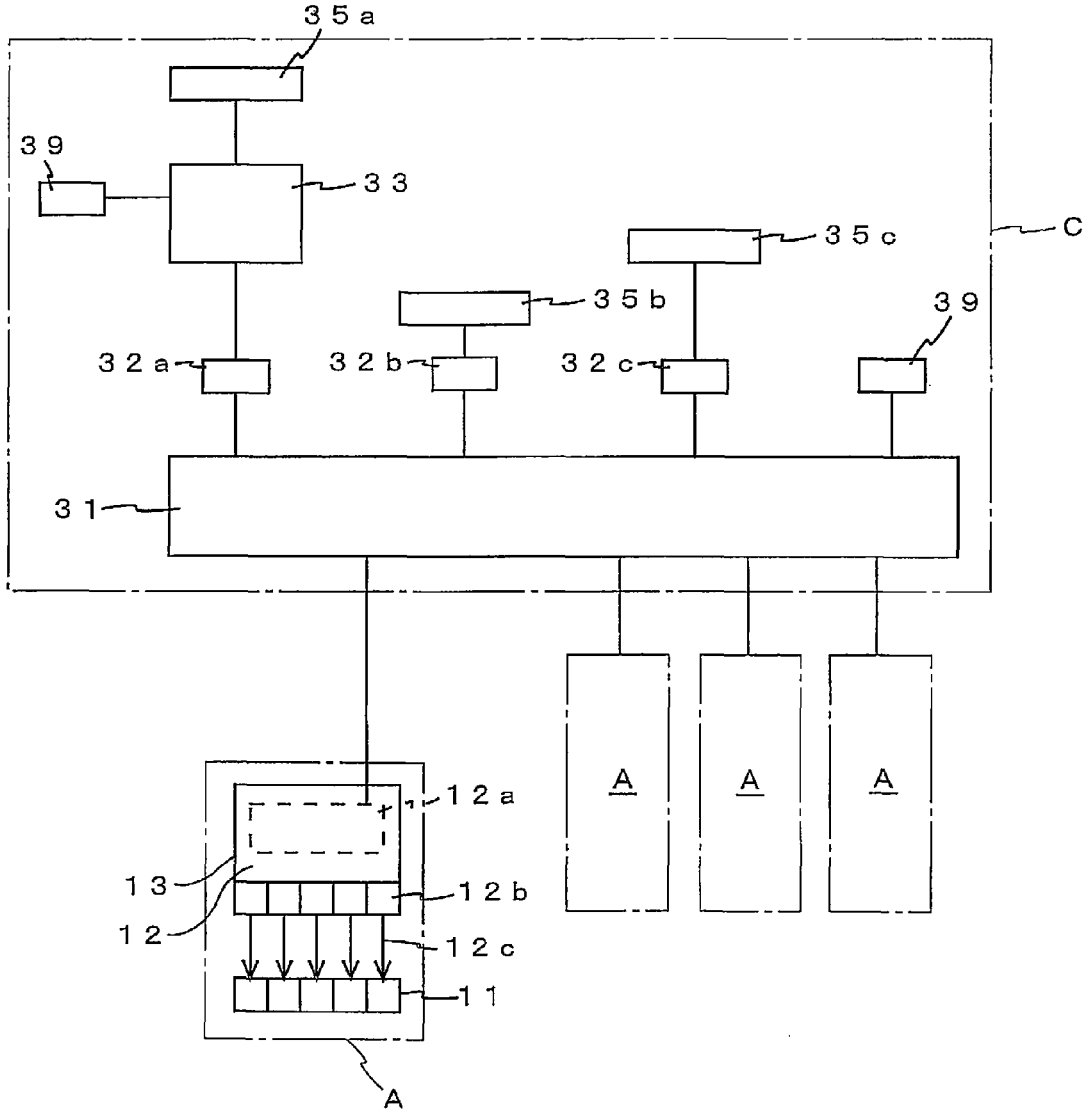
FIG. 3 is a descriptive diagram showing schematically a relationship between the inkjet portions and the air supply means in the inkjet recording apparatus according to the embodiment.

FIG. 3 is a descriptive diagram showing schematically a relationship between the inkjet portions and the air supply means in the inkjet recording apparatus according to the embodiment.

As shown in FIG. 3, the air supply means C has an air chamber 31 communicating with the spaces 12*a* in the distribution tanks 12 and a pressure adjustment mechanism provided on the air chamber 31 via a solenoid valve.

In the inkjet recording apparatus according to the embodiment, the pressure in the air chamber 31 is equal to the pressures of the spaces 12*a* in the distribution tanks 12, so that in conjunction with adjustment of the pressure in the air chamber 31, the pressures of the spaces 12*a* in the distribution tanks 12 is similarly adjusted.

In addition, since the air chamber 31 provided with the pressure adjustment mechanism is provided separately from the distribution tanks 12, it is unnecessary to attach the pressure adjustment mechanism to the distribution tank 12, unlike a conventional manner, so that the distribution tank 12 can be made compact.

Further, since the air chamber 31 is a member separate from the distribution tanks 12, the air chamber 31 can be installed anywhere in conformity to specifications of inkjet recording apparatuses.

Furthermore, even if backflow of ink occurs, the ink can be trapped in the air chamber 31, so that an accident can be avoided.

In this regard, the internal volume of the air chamber 31 is larger than the volume of the space 12*a*.

Since pressure fluctuation in the air chamber 31 due to the pressure adjustment mechanism becomes smaller as the volume of the air chamber 31 increases, the pressure in the distribution tank can be controlled with higher precision by adjusting the pressure in the air chamber 31 having the larger volume than by adjusting the pressure of the space 12a directly like a conventional manner.

Further, when the ink is consumed, the internal pressure of the sealed distribution tank 12 varies toward a negative pressure, but, since the air chamber 31 is connected to the space 12*a* of the distribution tank 12 so that the volume of the air chamber 31 increases, the degree of pressure variation based on the consumption of ink can be made smaller.

In this regard, a volume ratio (R1:R2) of a volume R1 of the space to an internal volume R2 of the air chamber is preferably in a range of 1:1.28 to 1:73.3, more preferably in a range of 1:1.28 to 1:36.7.

If the internal volume R2 of the air chamber 31 is less than 1.28 times the volume R1 of the space 12*a*, the effect that pressure control can be performed with higher precision might not be obtained, as compared with the case where the internal volume R2 of the air chamber 31 is within the above range, and if the internal volume R2 of the air chamber 31 is more than 73.3 times the volume R1 of the space 12*a*, the air chamber 31 becomes excessively large, and an extra space might be required, as compared with the case where the internal volume R2 of the air chamber 31 is within the above range.

The pressure adjustment mechanism includes a vacuum tank 33 attached to the air chamber 31 via a pressure-reducing solenoid valve 32*a*, a vacuum pump 35*a* connected to the vacuum tank 33, an air filter 35*b* attached to the air chamber 31 via an ambient-air solenoid valve 32*b* so as to communicate with ambient air, and a pressurizing pump 35*c* attached to the air chamber 31 via a pressurizing solenoid valve 32*c*.

Further, pressure gauges 39 for monitoring pressure are attached to the air chamber 31 and the vacuum tank 33, respectively.

In this regard, it is preferred that a reciprocating vacuum pump or an ejector type vacuum pump be used as the vacuum pump 35*a* in view of durability, and it is preferred that a reciprocating compressor be used as the pressurizing pump 35*c* in view of durability.

Further, the vacuum pump 35*a* is set so as to have a pressure of −5 to −6 kPa, for example, and the pressurizing pump 35*c* is set so as to have a pressure of approximately 98 kPa.

The vacuum pump 35*a* is attached via the vacuum tank 33. Therefore, even if air suddenly inflows, a breakdown of the vacuum pump 35*a* is suppressed due to existence of the vacuum tank 33.

The pressure in the air chamber 31 is made negative by the vacuum pump 35*a* based on opening and closing of the pressure-reducing solenoid valve 32*a*, is made equal to atmospheric pressure based on opening and closing of the ambient-air solenoid valve 32*b*, and is made positive by the pressurizing pump 35*c* based on opening and closing of the pressurizing solenoid valve 32*c*.

Since the pressure adjustment mechanism attached to the air chamber 31 uses these solenoid valves in this manner, the precision of pressure control is excellent.

Here, the "negative pressure" means a pressure reduced to lower than atmospheric pressure, while the "positive pressure" means a pressure increased to higher than atmospheric pressure.

In the inkjet recording apparatus according to the present invention, since the pressure adjustment mechanism is provided with the vacuum pump 35*a*, the air filter 35*b*, and the pressurizing pump 35*c*, the pressure can be easily adjusted. The details of the control will be described later.

The inkjet recording apparatus according to the present invention is provided with a fluid portion containing the ink supply means B and the air supply means C, and includes the inkjet portion A and the fluid portion containing the ink supply means B and the air chamber means C.

In this regard, in the inkjet recording apparatus, the inkjet portion A is a member separate from the fluid portion. Therefore, it becomes possible to make the inkjet portion A compact and dispose the fluid portion at an unobstructive desired location. Thereby, the working capacity of the inkjet recording can also be improved.

Further, for example, if the fluid portion is disposed so as to have the main tank 21 near the inkjet portion A, pressure loss due to a piping route can be reduced, so that it becomes possible to reduce the size of an ink supply pump and enhance the life thereof.

The inkjet portion A, as described above, has the recording head 11 for applying ink to a recording medium and the distribution tank 12 for supplying ink to the recording head 11.

In addition to these components, of course, the inkjet portion A may have a common inkjet configuration.

Figure 4:
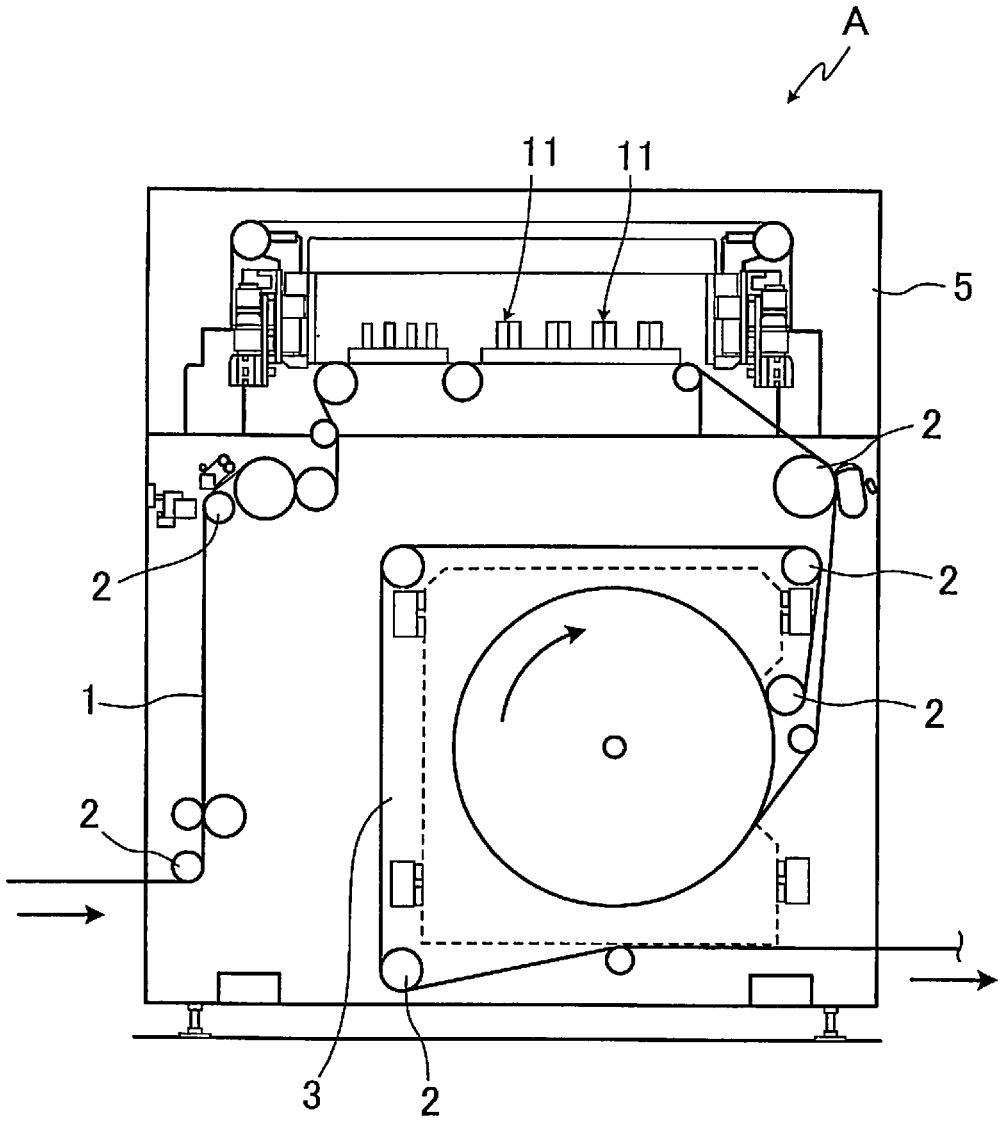
FIG. 4 is a front view showing the inkjet portion in the inkjet recording apparatus according to the embodiment.

FIG. 4 is a front view showing the inkjet portion in the inkjet recording apparatus according to the embodiment.

As shown in FIG. 4, in addition to the recording head 11 for applying ink to a recording medium 1 and the distribution tank (not shown) for supplying ink to the recording head 11, the inkjet portion A may have guide rollers 2 guiding the recording medium traveling, a drying machine 3 for drying the recording medium 1 which has been subjected to recording by the recording head 11, and a main body frame 5 containing these members.

Here, examples of the recording medium 1 include, but not limited to, a paper, a film, a cloth, a metallic foil, or another suitable material.

Further, the drying machine 3 has a cylindrical dryer, where the recording medium 1 is dried by bringing the recording medium 1 which has been applied with inkjet recording in close contact with a surface of the dryer.

In the inkjet recording portion A, the recording medium which has been fed therein is guided by the guide rollers 2 to the recording head 11. Then, the recording head 11 performs inkjet recording on the recording medium 1.

The recording medium 1 which has been subjected to inkjet recording is guided by other guide rollers 2 to the drying machine 3, and dried therein. Thereafter, the dried recording medium 1 is guided by other guide rollers 2 and discharged to the outside.

The fluid portion, as described above, contains the ink supply means B and the air supply means C.

Figure 5A:
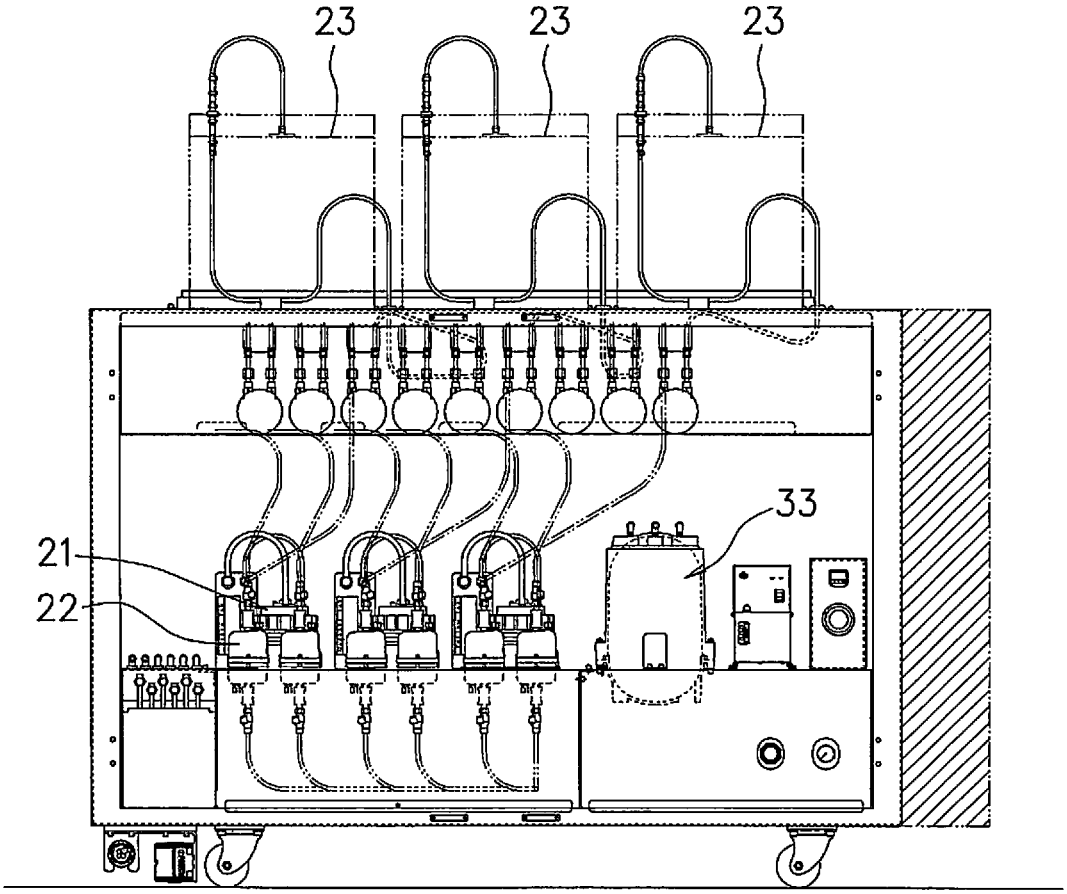
FIG. 5*a* is a right side view of a fluid portion in the inkjet recording apparatus according to the embodiment.
Figure 5B:
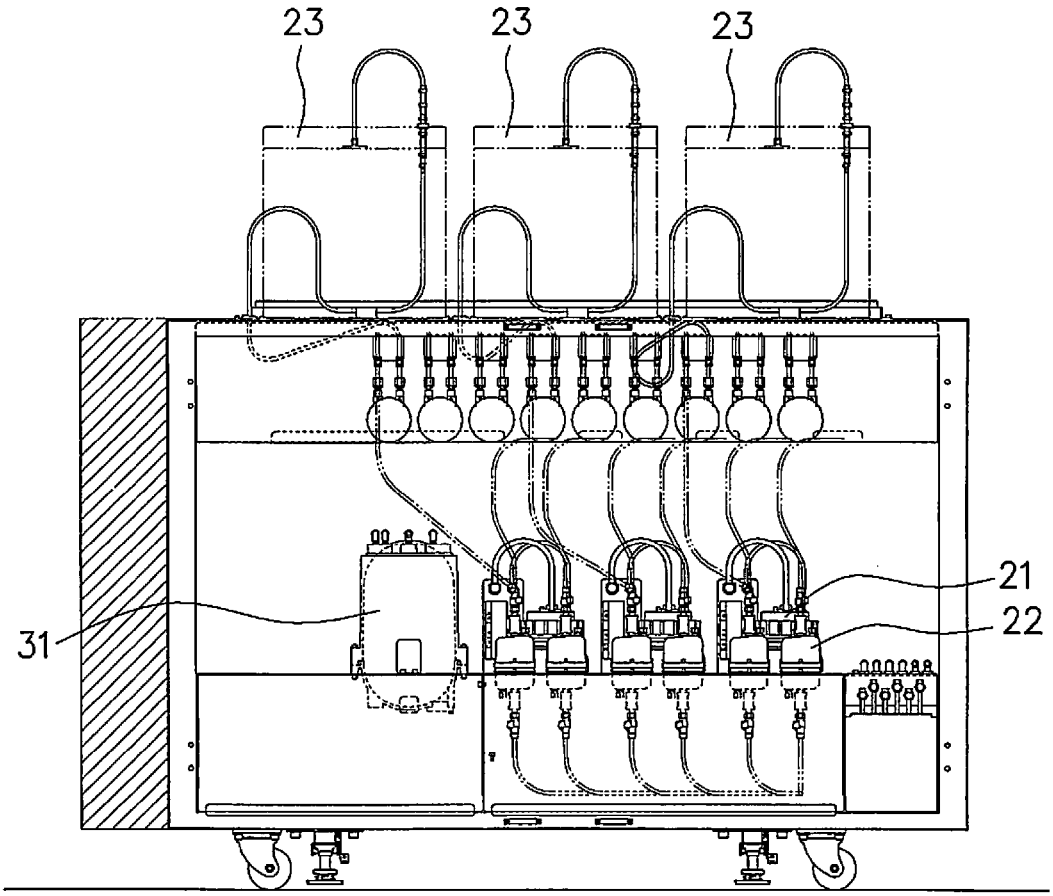
FIG. 5*b* is a left side view of a fluid portion in the inkjet recording apparatus according to the embodiment.

FIG. 5*a* is a right side view of the fluid portion in the inkjet recording apparatus according to the embodiment as viewed from the right side, and FIG. 5*b* is a left side view of the fluid portion in the inkjet recording apparatus according to the embodiment as viewed from the lift side.

As shown in FIGS. 5*a* and 5*b*, the fluid portion has wheels and can move freely.

In the right side of the fluid portion, as shown in FIG. 5*a*, the fluid portion has the ink packs 23 placed on the top face thereof. In the inner rear side, the main tanks 21 connected to their respective corresponding ink packs 23 via pumps by means of tubes and the deaerating modules 22 connected to the main tanks 21 via tubes are disposed. Incidentally, the deaerating modules 22 are connected to the distribution tanks of the inkjet portions A (not shown) via tubes. The check valves 25 are not shown in FIG. 5*a*.

On the other hand, the vacuum tank 33 is disposed in an inner front side of the fluid portion. Incidentally, the vacuum pump 35*a*, the air filter 35*b*, and the pressurizing pump 35*c* are not shown in FIG. 5*a*.

In the left side of the fluid portion, as shown in FIG. 5*b*, the fluid portion has the ink packs 23 placed on the top face thereof. In the inner rear side, the main tanks 21 connected to their respective corresponding ink packs 23 via pumps by means of tubes and the deaerating modules 22 connected to the main tanks 21 via tubes are disposed. Incidentally, the deaerating modules 22 are connected to the distribution tanks of the inkjet portions A (not shown) via tubes. The check valves 25 are not shown in FIG. 5*b*.

On the other hand, the air chamber 31 is disposed in an inner front side of the fluid portion. Incidentally, the solenoid valves 32*a*, 32*b*, 32*c* are not shown in FIG. 5*b*.

The front, rear, right, and left of the fluid portion are not particularly limited to those in FIGS. 5*a* and 5*b*, and, of course, these directions can be reversed.

In a control method of the inkjet recording apparatus according to the embodiment, the pressure in the air chamber is controlled so as to be negative during inkjet recording and during storage of the recording head 11.

Further, during restoring work where ink is forcibly discharged from the recording head 11, the pressure in the air chamber 31 is controlled so as to be positive.

For these reasons, ink leakage during inkjet recording and during storage of the recording head 11 can be suppressed, and, since the pressure in the air chamber 31 is controlled so as to be positive during restoring work where ink is forcibly discharged from the recording head 11, clogging of ink in the recording head 11 can be suppressed.

In a control method of the inkjet recording apparatus according to the embodiment, since the ambient-air solenoid valve 32*b* communicating with atmospheric pressure is attached to the air chamber 31, the loads on the pumps when the pressure is changed from positive to negative or when the pressure is changed from negative to positive can be reduced by opening the ambient-air solenoid valve 32*b* halfway to temporarily make the pressure equal to atmospheric pressure via the air filter 35*b*. That is, the negative pressure in the air chamber 31 can be once shifted to the atmospheric pressure, and then to the positive pressure, or the positive pressure in the air chamber 31 can be once shifted to the atmospheric pressure, and then to the negative pressure.

Though the embodiment of the present invention has been described above, the present invention is not limited to the above embodiment.

For example, the inkjet recording apparatus according to the above embodiment is provided with four inkjet portions A, four ink supply means for supplying ink to each of the inkjet portions B, and one air supply means for supplying air to these inkjet portions C, but the number of inkjet portions A and the number of ink supply means B for supplying ink to the inkjet portions A are not particularly limited.

For example, the number of the inkjet portions A, the number of ink supply means B, and the number of air supply members C may be the same as each other, or may be different from each other.

Figure 6A:
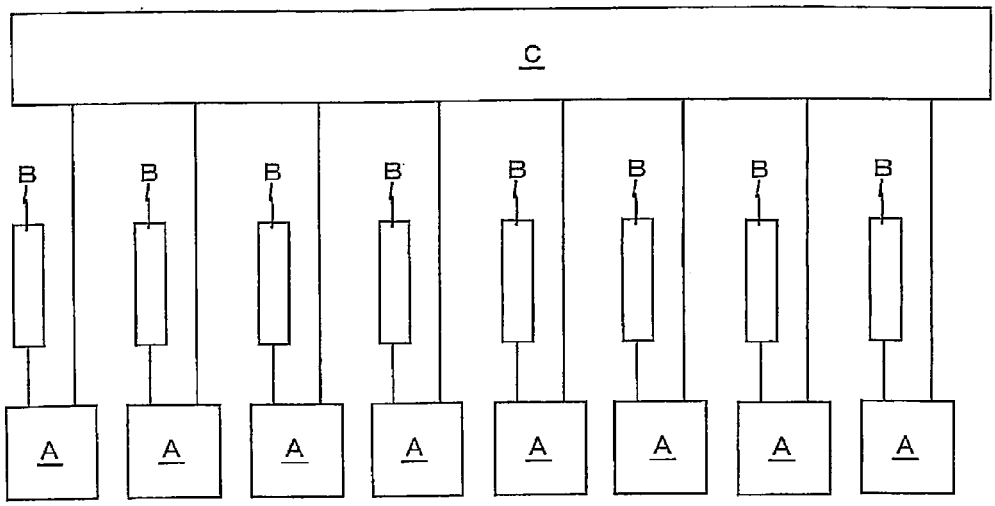
FIGS. 6*a* and 6*b* are descriptive diagrams showing schematically relationships between inkjet portions, air supply means, and an ink supply means in inkjet recording apparatuses according to other embodiments.
Figure 6B:
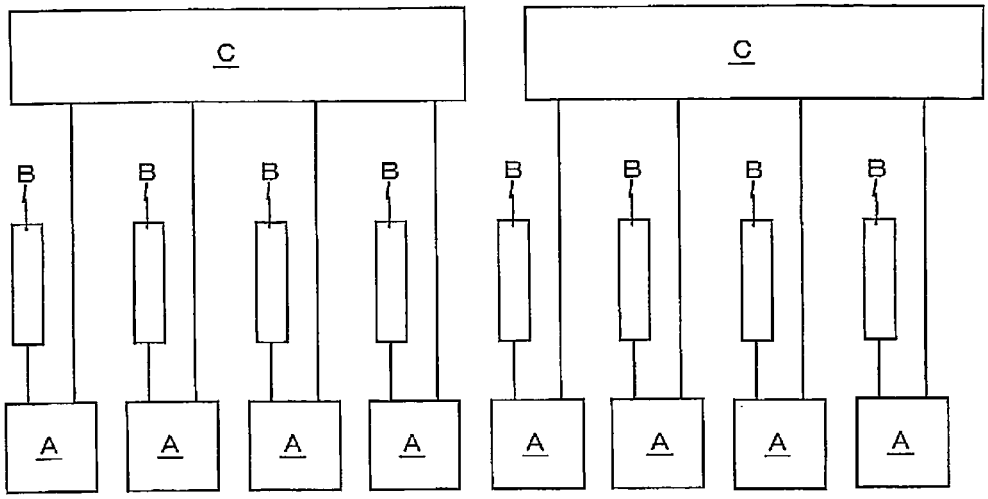

FIGS. 6(*a*) and 6(*b*) are descriptive diagrams showing schematically relations between inkjet portions, air supply means, and an ink supply means(s) in inkjet recording apparatuses according to other embodiments.

As shown in FIG. 6(*a*), eight inkjet portions A, eight ink supply means B for supplying inks to the inkjet portions A, respectively, and one air supply means C for supplying air to these inkjet portions A may be provided.

In addition, as shown in FIG. 6(*b*), two sets of four inkjet portions A, four ink supply means B for supplying ink to each of the inkjet portions A, and one air supply means C for supplying air to these ink portions A may be provided. Incidentally, if air supply means C is provided at a plurality of places, a plurality of air chambers may share a common vacuum tank.

In the inkjet recording apparatus according to the above embodiment, the inkjet portions A contain yellow (Y), magenta (M), cyan (C), and black (K) inks, respectively, but the inks are not limited to these YMCK.

For example, if five or more inkjet portions A are provided, a plurality of inkjet portions A may contain inks in the same color, or the inkjet portion A may contain an ink in a neutral color, an ink in a fluorescent color, an ink containing an anti-weathering agent, or the like.

The inkjet recording apparatus according to the above embodiment is of a line head system using a line head in the recording head 11, but the recording head may be of a serial head system.

In the inkjet recording apparatus according to the above embodiment, the pressure adjustment mechanism is provided with the air filter 35*b* attached to the air chamber 31 via the ambient-air solenoid valve 32*b* so as to communicate with ambient air, but the air filter 35*b* is not necessarily essential.

In the inkjet recording apparatus according to the above embodiment, the pressure-reducing solenoid valve 32*a*, the ambient-air solenoid valve 32*b*, and the pressurizing solenoid valve 32*c* are directly attached to the air chamber 31, but these solenoid valves may be attached via a manifold through which an air inflow route to the air chamber 31 is shared.

In the inkjet recording apparatus according to the above embodiment, the inkjet portion A and the fluid portion are separate members, but may be integrated with each other. That is, for example, the fluid portion may be contained in the main body frame 5 of the inkjet portion A shown in FIG. 4.

In the inkjet recording apparatus according to the above embodiment shown in FIGS. 5*a* and 5*b*, the ink packs 23 are placed on the top face of the fluid portion, but may be contained therein.

The vacuum pump, the air filter, and the pressurizing pump may also be installed outside the fluid portion.

Industrial Applicability

The present invention can be used as an inkjet recording apparatus of a pressure control type using a recording head to perform recording on a recording medium. According to such an inkjet recording apparatus, the distribution tank can be made compact, and the precision of pressure control is excellent.

Reference Signs List

1 . . . recording medium,
2 . . . guide roller,
3 . . . drying machine,
5 . . . main body frame,
11 . . . recording head,
12 . . . distribution tank,
12*a* . . . space,
12*b* . . . ink on-off solenoid valve,
12*c* . . . distribution supply pipe,
13 . . . circulation port,
13*a* . . . circulating flow passage,
21 . . . main tank,
22 . . . deaerating module,
23 . . . ink pack,
25 . . . check valve,
31 . . . air chamber,
32*a* . . . pressure-reducing solenoid valve,
32*b* . . . ambient-air solenoid valve,
32*c* . . . pressurizing solenoid valve,
33 . . . vacuum tank,
35*a* . . . vacuum pump,
35*b* . . . air filter,
35*c* . . . pressurizing pump,
39 . . . pressure gauge,
A . . . inkjet portion,
B . . . ink supply means, and
C . . . air supply means.

The invention claimed is:

1. An inkjet recording apparatus comprising:

an inkjet portion having a recording head for applying ink to a recording medium and a distribution tank for supplying ink to the recording head;

an ink supply means having a main tank for supplying ink to the distribution tank; and an air supply means having an air chamber communicating with a space in the distribution tank, and a pressure adjustment mechanism provided on the air chamber via a solenoid valve, wherein the pressure of the space and internal pressure of the air chamber are equal to each other and the pressure adjustment mechanism comprises a vacuum pump attached to the air chamber via a pressure-reducing solenoid valve, an air filter attached to the air chamber via an ambient-air solenoid valve so as to communicate with ambient air, and a pressurizing pump attached to the air chamber via a pressurizing solenoid valve.

2. The inkjet recording apparatus according to claim 1, wherein the internal volume of the air chamber is larger than the volume of the space.

3. The inkjet recording apparatus according to claim 1, wherein the volume ratio of volume R1 of the space to an internal volume R2 of the air chamber is in a range of 1:1.28 to 1:73.3.

4. The inkjet recording apparatus according to claim 1, wherein:

the ink supply means and the air supply means are contained in a fluid portion; and the inkjet portion and the fluid portion are separate members.

5. The inkjet recording apparatus according to claim 1, wherein the distribution tank supplies the ink to the recording head via an ink on-off solenoid valve.

6. The inkjet recording apparatus according to claim 1, wherein the main tank supplies ink to the distribution tank via a deaerating module.

7. The inkjet recording apparatus according to claim 1, wherein:

the distribution tank is provided with a circulation port; and ink in the distribution tank is circulated from the circulation port to the main tank through a circulating flow passage connected to the circulation port.

8. The inkjet recording apparatus according to claim 1, wherein:

the recording head includes a plurality of recording head sections;

the distribution tank includes a plurality of distribution tank sections corresponding to the number of the recording head sections; and spaces in the distribution tank sections communicate with the air chamber which is one in number.

* * * * *